US011179951B2

(12) United States Patent
Noda et al.

(10) Patent No.: US 11,179,951 B2
(45) Date of Patent: Nov. 23, 2021

(54) IMAGE RECORDING APPARATUS

(71) Applicant: BROTHER KOGYO KABUSHIKI KAISHA, Nagoya (JP)

(72) Inventors: Kengo Noda, Inazawa (JP); Yusuke Arai, Nagoya (JP); Takashi Suzuki, Toyota (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/003,592

(22) Filed: Aug. 26, 2020

(65) Prior Publication Data

US 2021/0060979 A1 Mar. 4, 2021

(30) Foreign Application Priority Data

Sep. 2, 2019 (JP) ..... JP2019-159752

(51) Int. Cl.
*B41J 11/00* (2006.01)
*B41J 13/03* (2006.01)
*B41J 13/00* (2006.01)

(52) U.S. Cl.
CPC ..... *B41J 11/007* (2013.01); *B41J 11/00* (2013.01); *B41J 13/0018* (2013.01); *B41J 13/0027* (2013.01); *B41J 13/03* (2013.01)

(58) Field of Classification Search
CPC . B41J 11/007; B41J 11/00; B41J 13/03; B41J 13/0027; B41J 13/0018
See application file for complete search history.

(56) References Cited

U.S. PATENT DOCUMENTS

2004/0032074 A1* 2/2004 Park ..... B65H 5/06 271/4.01
2016/0016419 A1* 1/2016 Mizuno ..... B41J 11/00 347/16
2018/0072075 A1 3/2018 Jimbo et al.
2018/0281478 A1* 10/2018 Oguchi ..... B41J 2/145

FOREIGN PATENT DOCUMENTS

JP 2007-210291 A 8/2007
JP 2016-022625 A 2/2016
JP 2018-039233 A 3/2018

* cited by examiner

*Primary Examiner* — Henok D Legesse
(74) *Attorney, Agent, or Firm* — Baker Botts L.L.P.

(57) ABSTRACT

There is provided an image recording apparatus, including: a feed roller; a conveyer; a recording head; a carriage; a motor; a transmission mechanism; a lock detector; and a controller. The controller is configured to: record image on recording medium by alternately repeating a line feed process and a recording process; start feeding of second recording medium, before the recoding of the image to first recoding medium is completed, by rotating the motor to drive the feed roller; continue, in a case that the motor lock state is detected before the recording of the image to first recording medium is completed, a control for rotating the motor, until a process for recoding the image to first recording medium being executed when the motor lock state is detected, is completed; and stop a driving of the motor after the process for recoding the image to first recording medium is completed.

11 Claims, 7 Drawing Sheets

IMAGE RECORDING APPARATUS

CROSS REFERENCE TO RELATED APPLICATION

The present application claims priority from Japanese Patent Application No. 2019-159752 filed on Sep. 2, 2019, the disclosure of which is incorporated herein by reference in its entirety.

BACKGROUND

The present disclosure relates to an image recording apparatus.

Japanese Patent Application Laid-open No. 2016-22625 discloses an image recording apparatus in which before printing for a preceding sheet is completed, a succeeding sheet is fed to a conveyance route, in order to perform fast image recording on a plurality of sheets.

When the image recording apparatus described in Japanese Patent Application Laid-open No. 2016-22625 feeds the succeeding sheet, rotation of a feed roller may stop, for example, when the feed roller is brought into contact with a sheet support surface of a tray due to paper out to cause great frictional force between the feed roller and the sheet support surface of the tray, or when frictional force between sheets loaded on the tray is greater than force by which the feed roller feeds the sheet. This causes a motor lock state in which the motor that drives the feed roller does not rotate. The motor lock state increases a load on a motor driving circuit that drives the motor.

Japanese Patent Application Laid-open No. 2007-210291 discloses a printer that decreases a load on a motor driving circuit caused by the motor lock state. In the printer described in Japanese Patent Application Laid-open No. 2007-210291, an encoder detects rotation of a feed roller. When a state in which the encoder does not detect rotation of the feed roller has continued for a predefined time, it is determined that the motor lock state is caused, and driving of the motor is stopped.

SUMMARY

In the printer described in Japanese Patent Application Laid-open No. 2007-210291, if driving of the motor is stopped immediately after the encoder determines that the motor lock state is caused, the state where rotation of the feed roller is stopped is released immediately. This makes the feed roller to which the load was applied rotate reversely and instantaneously.

In the image recording apparatus described in Japanese Patent Application Laid-open No. 2016-22625, driving force of one motor rotates the feed roller, a conveyance roller, and a discharge roller. Thus, when the feed roller rotates reversely, the conveyance roller and the discharge roller also rotate along with the reverse rotation of the feed roller. Thus, when the motor lock state is detected and the motor is stopped, the preceding sheet for which printing is being performed may be accidentally or unintentionally conveyed in a conveyance direction. This may decrease the quality in image recording for the preceding sheet.

The present disclosure is made to solve the above problem, and an object of the present disclosure is to provide an image recording apparatus that is capable of inhibiting a decrease in quality of image recording.

In order to solve the above problem, an image recording apparatus according to an aspect of the present disclosure includes: a feed roller configured to feed a recording medium to a conveyance route; a conveyer configured to convey the recording medium fed to the conveyance route in a conveyance direction; a recording head disposed downstream of the feed roller in the conveyance direction and configured to record an image by discharging ink onto the recording medium; a carriage configured to cause the recording head to reciprocate in a direction orthogonal to the conveyance direction; a motor configured to drive the feed roller and the conveyer; a transmission mechanism configured to transmit a rotation of the motor in a first direction to the conveyer without transmitting the rotation of the motor in the first direction to the feed roller, and configured to transmit the rotation of the motor in a second direction opposite to the first direction to the feed roller without transmitting the rotation of the motor in the second direction to the conveyer; a lock detector configured to detect a motor lock state in which the rotation of the motor instructed to drive is being stopped; and a controller.

The controller is configured to record the image on the recording medium by alternately repeating a line feed process and a recording process, the line feed process being a process in which the conveyer is driven to convey the recording medium in the conveyance direction by a conveyance amount corresponding to a line feed amount determined based on printing data, the recording process being a process in which the carriage is driven in a state where the conveyance of the recording medium is stopped to cause the recording head to record the image; to start feeding of a second recording medium, before the recoding of the image to the first recoding medium is completed, by rotating the motor in the second direction so as to drive the feed roller, the second recording medium being a medium to be conveyed next to the first recording medium; continue, in a case that the motor lock state is detected by the lock detector before the recording of the image to the first recording medium is completed, a control for rotating the motor in the second direction, until a process for recoding the image to the first recording medium being executed at a timing when the motor lock state is detected, is completed; and to stop a driving of the motor after the process for recoding the image to the first recording medium is completed.

In the image recording apparatus having the above configuration, in the case that the lock detector has detected the motor lock state before the image recording on the first recording medium is completed, the control for rotating the motor in the second direction is continued until the recording process for the first recording medium that is being executed at the time of detection of the motor lock state is completed. The driving of the motor is stopped after the recording process for the first recording medium is completed. This inhibits a situation in which the feed roller rotates reversely and instantaneously when the driving of the motor is immediately stopped and the first recording medium is unintentionally conveyed in the conveyance direction during image recording. A decrease in quality of image recording is thus inhibited.

According to an aspect of the present disclosure, a decrease in quality of image recording is inhibited.

DESCRIPTION OF THE EMBODIMENTS

First Embodiment

Figure 1:
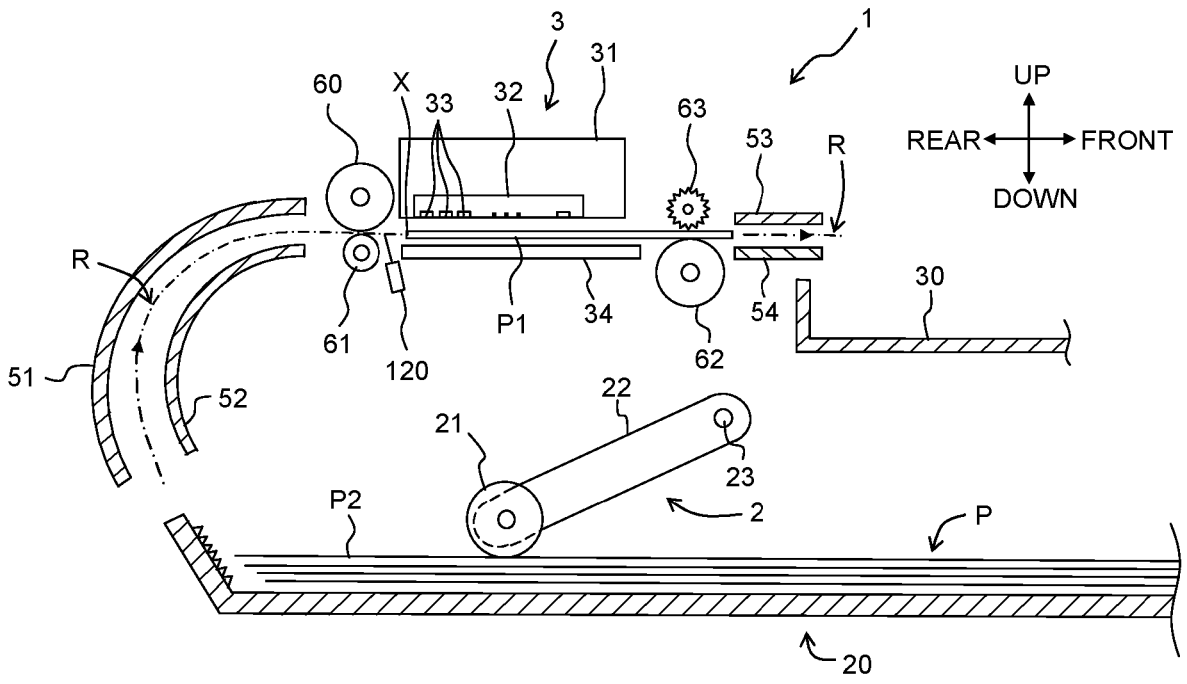
FIG. 1 schematically depicts an internal configuration of an image recording apparatus according to the first embodiment of the present disclosure.

Referring to FIGS. 1 to 6, an image recording apparatus 1 according to the first embodiment of the present disclosure is explained below. For the purpose of convenience in explanation, an upper side of FIG. 1 is defined as an upper side of the image recording apparatus 1, a lower side of FIG. 1 is defined as a lower side of the image recording apparatus 1, a left side of FIG. 1 is defined as a rear side of the image recording apparatus 1, and a right side of FIG. 1 is defined as a front side of the image recording apparatus 1.

<Schematic Configuration of Image Recording Apparatus>

The image recording apparatus 1 is a multifunction peripheral having a plurality of functions, such as a scan function, a print function, a copy function, and a facsimile function. The image recording apparatus 1 has a print function of an ink jet recording system in which print data is recorded on a recording medium P by discharging ink. The image recording apparatus 1 may be a printer only having the print function.

As depicted in FIG. 1, the image recording apparatus 1 includes a feed tray 20, a feeder (feed section) 2, a conveyance roller 60, a recording section 3, a discharge roller 62, and a discharge tray 30. A front surface of the image recording apparatus 1 is formed having an opening. In the opening, the box-like feed tray 20 of which upper surface is open is provided to be movable in a front-rear direction. A plurality of recording mediums P are stacked on top of each other and accommodated in the feed tray 20. The recording medium P is, for example, a sheet or paper having a predefined size. The recording medium P may be not only a paper medium but also a resin medium such as an OHP sheet.

The feeder 2 includes a feed roller 21, a feed arm 22, and a shaft 23. The feeder 2 feeds the recording medium P accommodated in the feed tray 20 to a conveyance route (path) R due to normal rotation of the feed roller 21. The feed roller 21 is rotatably supported by a front end of the feed arm 22. The feed arm 22 is pivotally supported by the shaft 23 supported by a frame of the image recording apparatus 1. The feed arm 22 is pivotally urged against the feed tray 20 due to its own weight or elastic force by a spring or the like. A transmission mechanism 80 transmits driving force caused by reverse rotation of a motor 102 depicted in FIG. 4 to the feed roller 21, which makes the feed roller 21 rotate normally.

The conveyance route R is referred to as a space formed by a guide member 51, a guide member 52, the recording section 3, a guide member 53, a guide member 54, and the like. The conveyance route R extends upward from a rear end of the feed tray 20, curves in an area defined by the guide members 51 and 52, passes through a position where the recording section 3 is provided, extends linearly in an area defined by the guide members 53 and 54, and leads to the discharge tray 30.

The conveyance roller 60 is disposed in the conveyance route R at an upstream side in the conveyance direction from the recording section 3. A pinch roller 61 is disposed at a position facing a lower portion of the conveyance roller 60. The conveyance roller 60 is driven by the motor 102. The pinch roller 61 rotates along with rotation of the conveyance roller 60. Normal rotation of the conveyance roller 60 and the pinch roller 61 causes the recording medium P to be nipped by the conveyance roller 60 and the pinch roller 61, and the recording medium P is conveyed to an image recording position X of the conveyance route R. The image recording position X is a position where the recording head 32 performs image recording on the recording medium P. Driving force caused by normal rotation of the motor 102 is transmitted to the conveyance roller 60 by the transmission mechanism 80 described below, thus rotating the conveyance roller 60 normally. Further, driving force caused by reverse rotation of the motor 102 is transmitted to the conveyance roller 60 by the transmission mechanism 80, thus rotating the conveyance roller 60 reversely. The normal rotation of the motor 102 corresponds to rotation in a first direction, and the reverse rotation of the motor 102 corresponds to rotation in a second direction.

Figure 4:
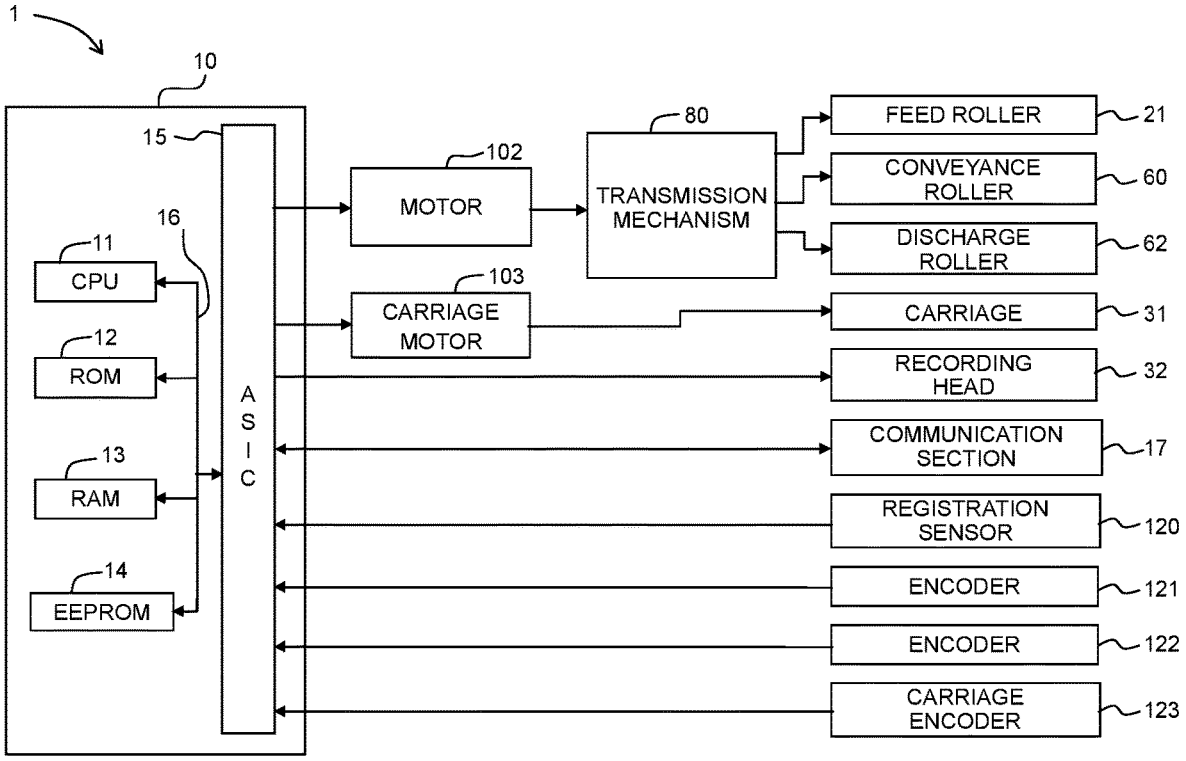
FIG. 4 is a block diagram of the image recording apparatus according to the first embodiment.

The recording section 3 is disposed between the conveyance roller 60 and the discharge roller 62 in the conveyance route R. The recording section 3 includes a carriage 31, the recording head 32, a plurality of nozzles 33, and a platen 34. When driving force of the carriage motor 103 depicted in FIG. 4 is transmitted to the carriage 31, the carriage 31 reciprocates in a direction orthogonal to the conveyance direction (i.e., a width direction of the recording medium P). The controller 10 of the image recording apparatus 1 repeats a recording process and a line feed process during image recording on the recording medium P. In the recording process, an image corresponding to one line is recorded on the recording medium P by discharging ink from the nozzles 33 of the recording head 32 during movement in the width direction of the recording medium P of the carriage 31 with conveyance of the recording medium P being stopped. In the line feed process, the recording medium P is conveyed by a predefined line feed amount by driving the conveyance roller 60 and the discharge roller 62. In the following, one scan of the carriage 31 (movement in the width direction of the recording medium P) in the image recording, in which image recording corresponding to one line is performed, is defined as one pass.

As depicted in FIG. 1, the carriage 31 carries the recording head 32. The nozzles 33 are provided in a lower surface of the recording head 32. The recording head 32 discharges ink droplets from the nozzles 33 by vibrating driving elements, such as piezo elements. The platen 34 is a rectangular plate-like member on which the recording medium P is placed. An image is recorded on the recording medium P by causing the recording head 32 to selectively discharge ink droplets on the recording medium P supported by the platen 34 during movement of the carriage 31.

The carriage 31 is provided with a carriage encoder 123. The carriage encoder 123 is a linear encoder that outputs an encoder signal depending on a change in position in the width direction of the recording medium P of the carriage 31. The carriage encoder 123 includes an encoder scale and an optical sensor (not depicted). The encoder scale is disposed on a frame that supports the carriage 31, along the width direction of the recording medium P. The optical sensor is carried on the carriage 31. The carriage encoder 123 inputs, to the controller 10, an encoder signal depending on a change in a relative position between the encoder scale and the optical sensor.

The discharge roller 62 as the conveyer is disposed in the conveyance route R at a downstream side in the conveyance direction from the recording section 3. A spur 63 is disposed at a position facing an upper portion of the discharge roller 62. The discharge roller 62 is driven by the motor 102. The spur 63 rotates along with rotation of the discharge roller 62. Normal rotation of the discharge roller 62 and the spur 63 causes the recording medium P to be nipped by the discharge roller 62 and the spur 63, and the recording medium P is discharged onto the discharge tray 30.

The discharge tray 30 is disposed above the feed tray 20. The discharge tray 30 supports the recording medium P discharged by the discharge roller 62.

A registration sensor 120 as a recording medium sensor is provided between the conveyance roller 60 and the recording section 3 in the conveyance route R. The registration sensor 120 detects that the recording medium P passes a contact position where the recording medium P comes into contact with the conveyance roller 60. The registration sensor 120 may be a sensor having an actuator that swings by the contact with the recording medium P, an optical sensor, or the like. The registration sensor 120 outputs an on signal in a state where the recording medium P passes the contact position between the recording medium P and the conveyance roller 60 (i.e., a state where a front end of the recording medium P is positioned at the downstream side in the conveyance direction from the contact position), and outputs an off signal in a state where no recording medium P passes the contact position between the recording medium P and the conveyance roller 60 (i.e., a state where the front end of the recording medium P is positioned at the upstream side in the conveyance direction from the contact position). The detection signal of the registration sensor 120 is output to the controller 100.

The conveyance roller 60 is provided with an encoder 121 that detects rotation of the conveyance roller 60. The encoder 121 outputs a pulse signal to the controller 10 depending on rotation of the conveyance roller 60.

Figure 2:
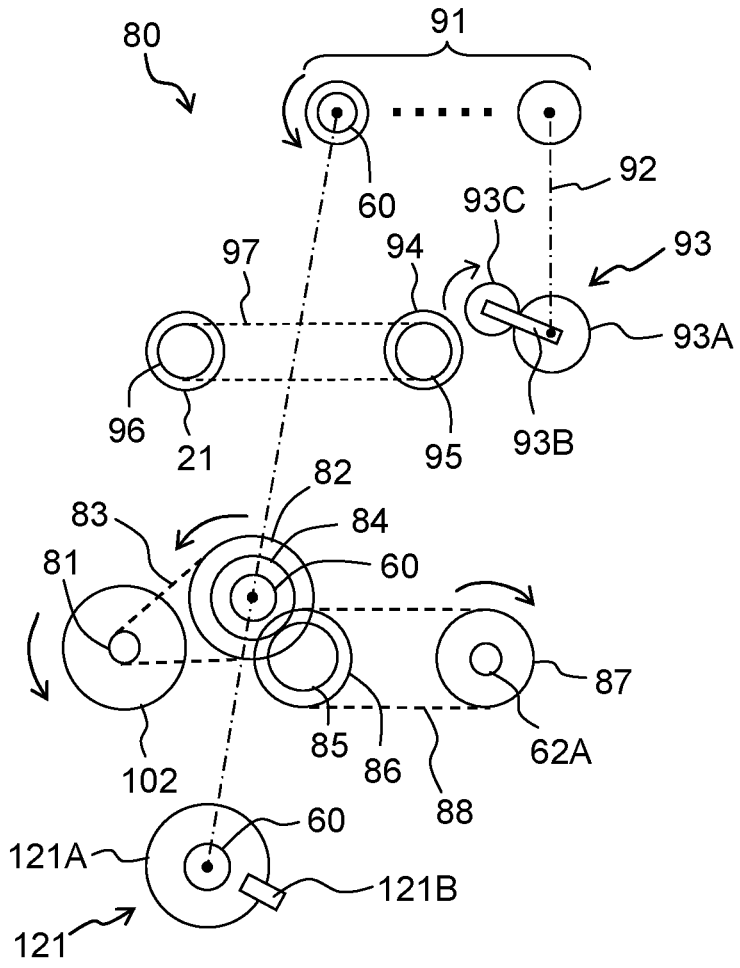
FIG. 2 depicts a schematic configuration of a transmission mechanism according to the first embodiment in a non-transmission state.
Figure 3:
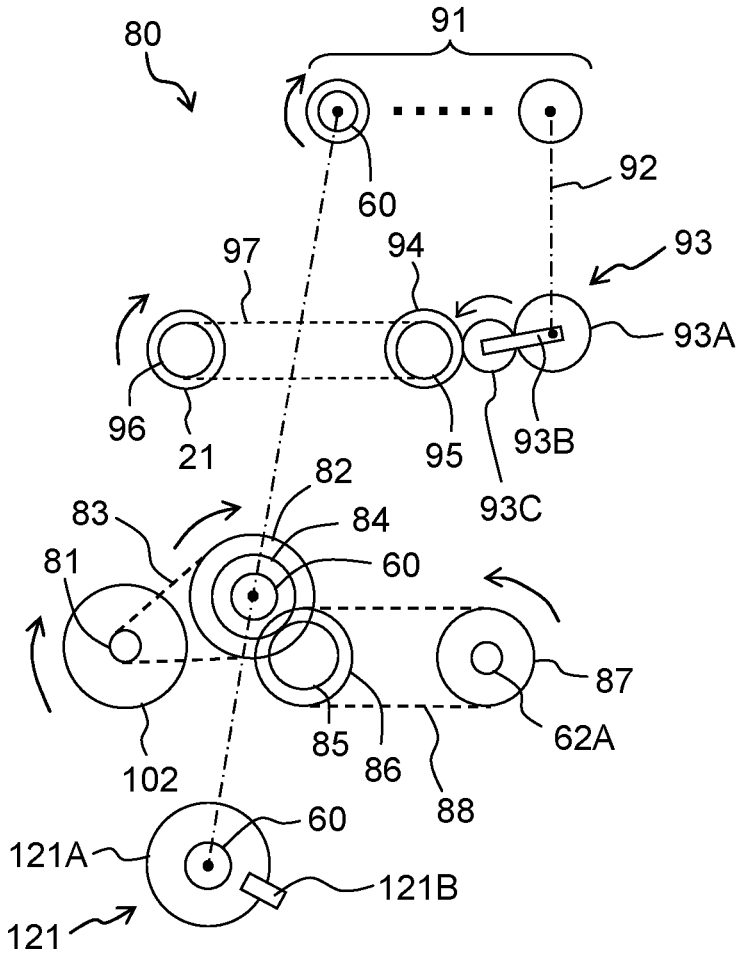
FIG. 3 depicts a schematic configuration of the transmission mechanism according to the first embodiment in a transmission state.

Specifically, the encoder 121 includes an encoder disk 121A and an optical sensor 121B, as depicted in FIGS. 2 and 3. The encoder disk 121A rotates along with rotation of the conveyance roller 60. The optical sensor 121B generates a pulse signal by reading the rotating encoder disk 121A, and outputs the generated pulse signal to the controller 10.

Further, the feed roller 21 is provided with an encoder 122 that detects rotation of the feed roller 21. The encoder 122 has a configuration similar to the encoder 121, and outputs a pulse signal to the controller 10 depending on rotation of the feed roller 21.

In this embodiment, the encoder 122 functions as a lock detecting section (lock detector) that detects a motor lock state in which rotation of the motor 102 is stopped although a driving instruction is received. The lock detecting section is not limited to the encoder that detects rotation of the feed roller 21, but may be a current sensor that detects a driving current value of the motor 102. In this configuration, when the driving current value of the motor 102 exceeds a predefined value for a certain time or longer, the lock detecting section determines that the motor lock state is caused. Or, the motor lock state may be detected by using an instruction value (PWM value) transmitted from the controller 10 to the motor 102.

Referring to FIGS. 2 and 3, the transmission mechanism 80 is explained below. FIG. 2 depicts a schematic configuration of the transmission mechanism 80 in a non-transmission state (i.e., a state where rotational driving force of the motor 102 is not transmitted to the feed roller 21). FIG. 3 depicts a schematic configuration of the transmission mechanism 80 in a transmission state (i.e., a state where rotational driving force of the motor 102 is transmitted to the feed roller 21). As depicted in FIGS. 2 and 3, the transmission mechanism 80 transmits the rotational driving force of the motor 102 to the feed roller 21, the conveyance roller 60, and the discharge roller 62. The configuration of the transmission mechanism 80 depicted in FIGS. 2 and 3 is an example, and is not limited thereto.

As depicted in FIG. 2, the transmission mechanism 80 includes a pulley 81 that rotates integrally with a motor shaft of the motor 102, a pulley 82 that rotates integrally with the conveyance roller 60, and an endless ring-like belt 83 wound between the pulley 81 and the pulley 82. Further, the transmission mechanism 80 includes a gear 84 that rotates integrally with the conveyance roller 60, a gear 85 that meshes with the gear 84, a pulley 86 that rotates integrally with the gear 85, a pulley 87 that rotates integrally with a shaft 62A of the discharge roller 62, and an endless ring-like belt 88 wound between the pulley 86 and the pulley 87.

The transmission mechanism 80 thus transmits the driving force of normal rotation (rotation in the first direction) of the motor 102 to the conveyance roller 60 and the discharge roller 62, rotating the conveyance roller 60 and the discharge roller 62 normally. The normal rotation of the conveyance roller 60 and the discharge roller 62 conveys the recording medium P in the conveyance direction.

A publicly-known one-way clutch (not depicted) is provided inside the pulley 87. Namely, the pulley 87 is attached to the shaft 62A via the one-way clutch. The transmission mechanism 80 thus transmits, to the discharge roller 62, rotational driving force of the motor 102 that is driven to rotate normally, and does not transmit, to the discharge roller 62, rotational driving force of the motor 102 that is driven to rotate reversely.

Further, the transmission mechanism 80 includes a gear array 91 that transmits rotation of the conveyance roller 60 to a rotational shaft 92, a pendulum gear mechanism 93 that rotates along with rotation of the rotational shaft 92, a gear 94 that comes into contact with and separates from a pendulum gear 93C, a pulley 95 that rotates integrally with the gear 94, a pulley 96 that rotates integrally with the feed roller 21, and an endless ring-like belt 97 wound between the pulley 95 and the pulley 96. The pendulum gear mechanism 93 includes a sun gear 93A that rotates integrally with the rotational shaft 92, a support arm 93B that is pivotally attached to the rotational shaft 92, and the pendulum gear 93C that is rotatably supported by a front end of the support arm 93B and meshes with the sun gear 93A. The pendulum gear 93C rotates around own axis while revolving around the sun gear 93A by the transmitting of rotational driving force of the motor 102 to the sun gear 93A.

Specifically, in the non-transmission state depicted in FIG. 2, the pendulum gear 93C moves or revolves around the sun gear 93A in a direction away from the gear 94 by the transmitting of the driving force of normal rotation of the motor 102 to the sun gear 93A. Thus, the transmission mechanism 80 does not transmit the driving force of normal rotation of the motor 102 to the feed roller 21. On the other hand, in the transmission state depicted in FIG. 3, the pendulum gear 93C revolves around the sun gear 93A in a direction approaching the gear 94 and meshes with the gear 94 by the transmitting of the driving force of reverse rotation of the motor 102 to the sun gear 93A. Thus, the transmission mechanism 80 transmits the driving force of reverse rotation of the motor 102 to the feed roller 21, and rotates the feed roller 21 normally.

FIG. 4 is a block diagram of the image recording apparatus 1 according to the first embodiment. As depicted in FIG. 4, the controller 10 includes a CPU 11, a ROM 12, a RAM 13, an EEPROM 14 (trade name), and an ASIC 15. Those are connected to each other via an internal bus 16. Programs and the like for allowing the CPU 11 to control various kinds of operations are stored in the ROM 12. The RAM 13 is used as a storage area in which data, signals, and the like, used by the CPU 11 executing the above programs are saved temporarily, or a working area for data processing. The EEPROM 14 stores setting information that is required to be held or kept after the image recording apparatus 1 is turned off.

The ASIC 15 is connected to the motor 102 and the carriage motor 103. The ASIC 15 supplies driving current to the motor 102 and the carriage motor 103 via a driving circuit (not depicted). Each of the motor 102 and the carriage motor 103 is a DC motor in which rotational velocity is faster as the driving current supplied is greater and rotational velocity is slower as the driving current supplied is smaller. The controller 10 controls rotation of the motor 102 and the carriage motor 103 by, for example, the Pulse Width Modulation (PWM) control.

The controller discharges ink droplets from the nozzles 33 by applying driving voltage to vibration elements of the recording head 32. The ASIC 15 is connected to the registration sensor 120, the encoder 121, the encoder 122, and the carriage encoder 123. The controller 10 detects a state of the image recording apparatus 1 based on signals output from the registration sensor 120, the encoder 121, the encoder 122, and the carriage encoder 123.

Specifically, the controller 10 detects that the recording medium P has passed the contact position with the conveyance roller 60 based on a detection signal output from the registration sensor 120. The controller 10 detects a rotation amount of the conveyance roller 60 based on a pulse signal output from the encoder 121, and detects a rotation amount of the feed roller 21 based on a pulse signal output from the encoder 122. The controller 10 infers a position of the recording medium P in the conveyance route R based on a pulse signal that is output from the encoder 121 after the on signal is output from the registration sensor 120.

The controller 10 detects a position of the carriage 31 in the width direction of the recording medium P based on an encoder signal input from the carriage encoder 123. The controller 10 has a function as a discharge detecting section that obtains printing data and detects completion of ink discharge from the recording head 32 in the recording process based on the obtained printing data and the detection position of the carriage 31.

The ASIC 15 is connected to a communication section 17. The communication section 17 is a communication interface that is capable of communicating with an information processing apparatus (not depicted). Namely, the controller 10 transmits a variety of information to the information processing apparatus via the communication section 17, and receives a variety of information from the information processing apparatus via the communication section 17.

<Control Operation of Controller>

Figure 5:
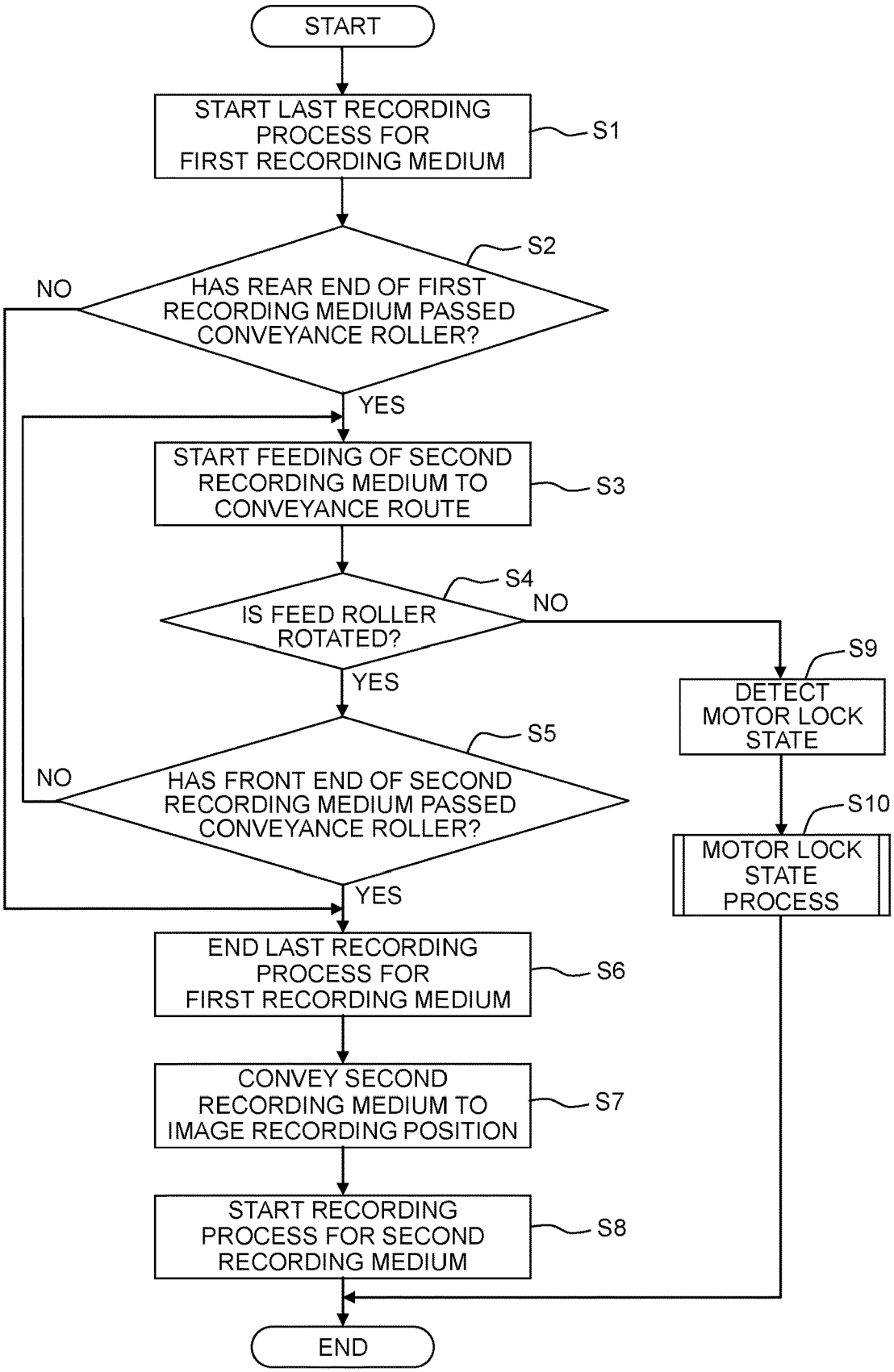
FIG. 5 is a flowchart indicating a process flow after a start of the last recording process when a continuous print operation is performed in the image recording apparatus according to the first embodiment.
Figure 6:
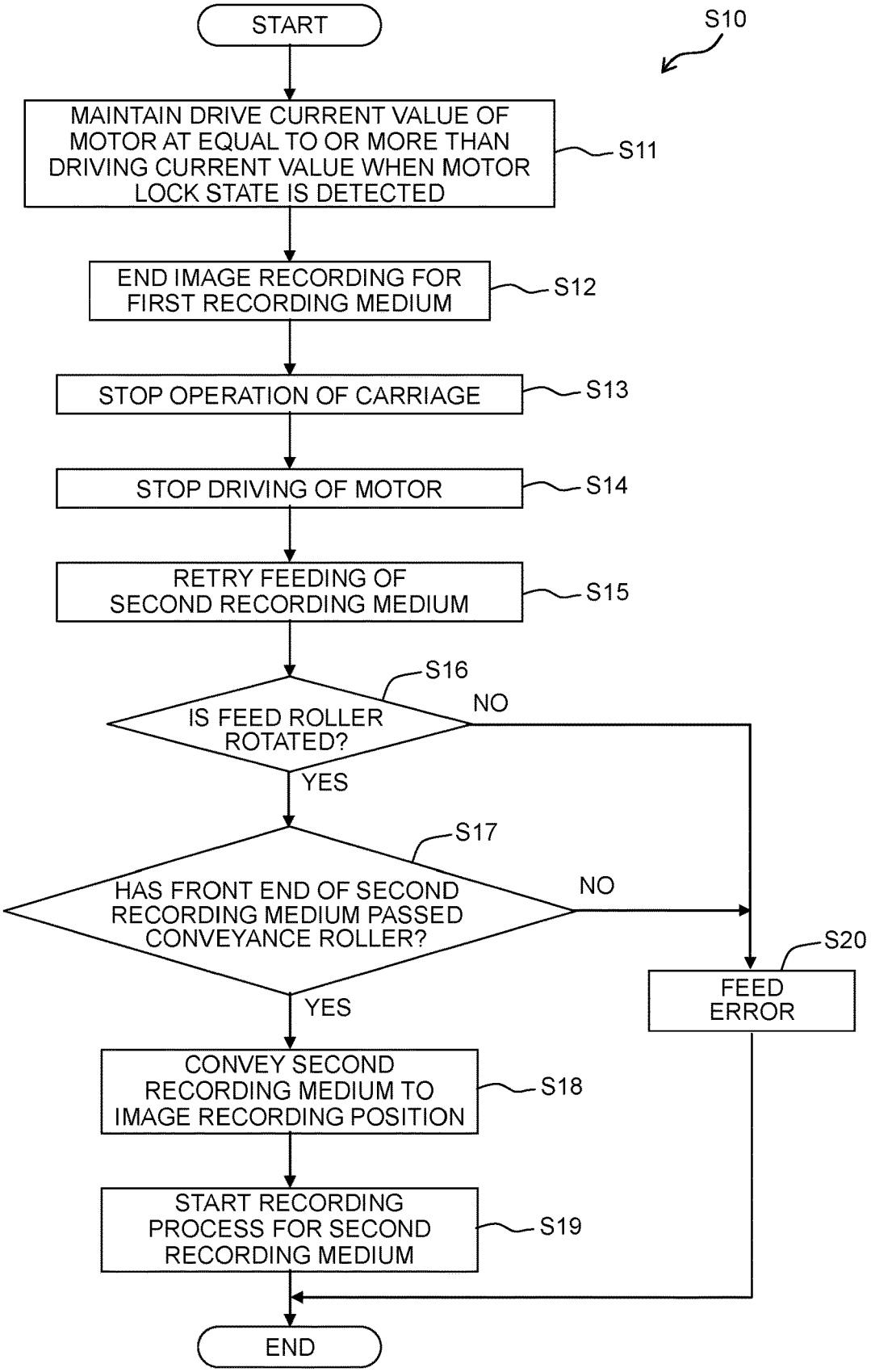
FIG. 6 is a flowchart indicating a process flow of a motor lock state process of the image recording apparatus according to the first embodiment.

Referring to flowcharts in FIGS. 5 and 6, explanation is made about control operations in image recording performed by the controller 10 of the image recording apparatus 1 according to the first embodiment. FIG. 5 is a flowchart indicating a process flow after a start of the last recording process when a continuous printing operation is performed in the image recording apparatus 1 according to the first embodiment. FIG. 6 is a flowchart indicating a process flow of a motor lock state process of the image recording apparatus 1 according to the first embodiment. The flowcharts in FIGS. 5 and 6 are just examples, and the present disclosure is not limited thereto.

The controller 10 first obtains printing data, and then determines a line feed amount, by which a first recording medium P1 is conveyed between passes, based on the obtained printing data. Next, the controller 10 normally rotates the feed roller 21 by reversely rotating the motor 102, feeding the first recording medium P1, which is a recording medium precedently conveyed from the feed tray 20, to the conveyance route R. When a front end of the first recording medium P1 fed to the conveyance route R has reached the conveyance roller 60, the controller 10 normally rotates the conveyance roller 60 and the discharge roller 62 by switching rotation of the motor 102 from the reverse rotation to the normal rotation, and conveys the front end side of the first recording medium P1 to the recording section 3. The controller 10 determines that the front end of the first recording medium P1 has reached the conveyance roller 60 by detecting, based on a pulse signal input from the encoder 122, that the rotation amount of the feed roller 21 has reached a predefined amount required for conveying the first recording medium P from the feed tray 20 to the conveyance roller 60.

Then, the controller 10 performs image recording by alternately repeating a line feed process and the recording process described below for the first recording medium P1 conveyed to the recording section 3. Namely, in the line feed process, the controller 10 drives the conveyance roller 60 and the discharge roller 62 by normally rotating the motor 102 and conveys the first recording medium P1 in the conveyance direction by a conveyance amount corresponding to the determined line feed amount. Further, in the recording process, the controller 10 records an image corresponding to one line by moving the carriage 31 in a width direction of the first recording medium P1 through driving of the carriage motor 103 in a state where conveyance of the first recording medium P is stopped, and discharging ink droplets onto the first recording medium P from the nozzles 33 of the recording head 32.

When image recording is performed by passes for the first recording medium P1, the controller 10 repeats the line feed process and the recording process and then starts the last recording process for the first recording medium P1 (S1), as indicated in FIG. 5. In this case, the last recording process for the first recording medium P1 means a recording process of the last pass for the first recording medium P1. When the last recording process is started, the controller 10 determines whether a rear end of the first recording medium P1 has passed a contact position with the conveyance roller 60 (S2). Specifically, the controller 10 determines whether the rear end of the first recording medium P1 has passed the contact position with the conveyance roller 60, based on that the detection signal from the registration sensor 120 is changed from the on signal to the off signal. In 51, the controller 10 may start a recording process of any other pass than the last pass from among the passes for the first recording medium P1.

When the rear end of the first recording medium P1 has not passed the contact position with the conveyance roller 60 (S2: NO), the controller 10 proceeds to S6 described below. When the rear end of the first recording medium P1 has passed the contact position with the conveyance roller 60 (S2: YES), the controller 10 starts feeding of the second recording medium P2, which is conveyed next to the first recording medium P1, to the conveyance route R (S3).

Specifically, the controller 10 normally rotates the feed roller 21 via the transmission mechanism 80 by reversely rotating the motor 102 in a state where the first recording medium P1 is brought into contact with the discharge roller 62. The normal rotation of the feed roller 21 feeds the second recording medium P2 from the feed tray 20 to the conveyance route R. It is assumed that the recording process for the first recording medium P1 being executed at the time of the start of feeding of the second recording medium P2 is not yet completed when the feeding of the second recording medium P2 is started.

Subsequently, the controller 10 determines whether the feed roller 21 is rotated (S4). Specifically, when no pulse signal is output from the encoder 122, the controller 10 determines that rotation of the feed roller 21 is stopped.

When the feed roller 21 is not rotated (S4: NO), the controller 10 detects that the motor lock state is caused in the motor 102 (S9), and performs the motor lock state process indicated in FIG. 6 (S10). Here, the motor lock state is referred to as a state in which rotation of the motor 102 is stopped although a driving instruction from the controller 10 is received.

On the other hand, when the feed roller 21 is rotated (S4: YES), the controller 10 determines whether a front end of the second recording medium P2 has passed the contact position with the conveyance roller 60 (S5). Specifically, the controller 10 determines that the front end of the second recording medium P2 has passed the contact position with the conveyance roller 60, based on that the detection signal from the registration sensor 120 is changed from the off signal to the on signal.

When the front end of the second recording medium P2 has not passed the contact position with the conveyance roller 60 (S5: NO), the controller 10 returns to S3. When the front end of the second recording medium P2 has passed the contact position with the conveyance roller 60 (S5: YES), the controller 10 completes the last recording process for the first recording medium P1 (S6) and conveys the second recording medium P2 to the image recording position X (S7). Then, the controller 10 starts the recording process for the second recording medium P2 (S8).

When the controller 10 has determined in S2 that the rear end of the first recording medium P1 has not passed the contact position with the conveyance roller 60 (S2: NO), the controller 10 performs the following processes in S6 and S7. Namely, in S6, the controller 10 conveys the first recording medium P1 after the last recording process for the first recording medium P1 is completed until the rear end of the first recording medium P1 passes the contact position with the conveyance roller 60. This conveyance is performed for the following reason. Namely, when the second recording medium P2 is conveyed in S7, the feed roller 21 is required to rotate normally by reversely rotating the motor 102. In this case, it is necessary to inhibit a situation in which the first recording medium P1 moves backward in the conveyance direction, that is moves in a direction opposite to the conveyance direction, due to reverse rotation of the conveyance roller 60. The controller 10 determines that the rear end of the first recording medium P1 has passed the contact position with the conveyance roller 60 based on that the detection signal from the registration sensor 120 is changed from the on signal to the off signal. Then, the controller 10 drives the feed roller 21 and the conveyance roller 60 to convey the second recording medium P2 from the feed tray 20 to the image recording position X (S7), and starts the recording process for the second recording medium P2 (S8).

Next, the motor lock state process S10 indicated in FIG. 6 is explained. The controller 10 at first maintains the driving current value of the motor 102 at equal to or more than a driving current value at the timing at which the motor lock state is detected (S11). This inhibits a state, in which rotation of the feed roller 21 is stopped, from being released immediately which may otherwise be caused by stopping the driving of the motor 102 or lowering the driving current value of the motor 102 immediately after the motor lock state is caused.

Subsequently, the controller 10 completes image recording for the first recording medium P1 (S12), and stops operation of the carriage 31 by stopping the carriage motor 103 (S13). Then, the controller 10 stops driving of the motor 102 (S14).

Next, the controller 10 retries feeding of the second recording medium P2 by again driving and reversely rotating the motor 102 (S15). Here, the controller 10 controls so that a driving current value larger than that for usual paper feeding flows to the motor 102. The controller 10 thus performs the retry of feeding of the second recording medium P2 satisfactorily.

Subsequently, the controller 10 determines whether the feed roller 21 is rotated based on a pulse signal input from the encoder 122 (S16). When the feed roller 21 is rotated (S16: YES), the controller 10 determines whether the front end of the second recording medium P2 has passed the contact position with the conveyance roller 60 by a method similar to S5 (S17). When the registration sensor 120 has detected that the front end of the second recording medium P2 has passed the contact position with the conveyance roller 60 (S17: YES), the controller 10 conveys the second recording medium P2 to the image recording position X (S18) and starts the recording process for the second recording medium P2.

On the other hand, when the feed roller 21 is not rotated (S16: NO), or when the registration sensor 120 does not detect that the front end of the second recording medium P2 has passed the contact position with the conveyance roller 60 after a predefined time, which is required for the operation in which the front end of the second recording medium P2 passes through the conveyance roller 60 after the feed roller 21 starts the feeding of the second recording medium P2, is elapsed (S17: NO), the controller 10 determines that a feed error is caused (S20). For example, the controller 10 displays an error indication on a display section (not depicted). Then, the controller 10 ends the motor lock state process (S10) according to the first embodiment.

In the image recording apparatus 1 according to the first embodiment, when the motor lock state is detected by the encoder 122 before image recording for the first recording medium P1 is completed (S9), the rotation control of reverse rotation of the motor 102 is continued until the recording process for the first recording medium P1 being executed at the time of detection of the motor lock state is completed (S11). The driving of the motor 102 is stopped (S14) after the recording process for the first recording medium P1 is completed (S12). If the driving of the motor 102 is stopped immediately, the feed roller 21 rotates reversely and instantaneously. This reverse rotation of the feed roller 21 is transmitted to the conveyance roller 60 and the discharge roller 62 via the transmission mechanism 80, thus rotating the rollers 60 and 62 normally. Thus, by the above process, it is possible to inhibit a situation in which the first recording medium P1 is conveyed in the conveyance direction during image recording, and to inhibit a decrease in quality of image recording.

When the motor lock state is detected by the encoder 122 (S9), the controller 10 maintains the driving current value of the motor 102 at equal to or more than the driving current value at the timing at which the motor lock state is detected (S11), until the driving of the motor 102 is stopped (S14). By doing so, it is possible to inhibit unintentional movement of the first recording medium P1 in the conveyance direction, caused by sudden or abrupt release from the state where rotation of the feed roller 21 is stopped.

Further, the controller 10 retries the feeding of the second recording medium P2 (S15) by again rotating the motor reversely in a state where the carriage 31 is stopped after the driving of the motor 102 is stopped (S14). By doing so, it is possible to inhibit the occurrence of feed error.

Further, the controller 10 improves a success rate of the feed retry by making a driving current value of the motor 102 when the feeding of the second recording medium P2 is retried, larger than a driving current value of the motor 102 when the second recording medium P2 is fed normally (under a normal condition).

Further, the controller 10 accurately detects the motor lock state of the motor 102 by using a signal output from the encoder 122 that detects rotation of the feed roller 21.

As described above, when the driving of the motor 102 is stopped in the motor lock state process (S10), the feed roller 21 rotates reversely and instantaneously and the first recording medium P1 is conveyed in the conveyance direction. This causes a shift or deviation in the line feed amount of the line feed process to be executed after the recording process that is being executed when the motor lock state is caused. Image recording in the next recording process, if it exists, may thus have failure. In the image recording apparatus 1 according to the first embodiment, the controller 10 starts the feeding of the second recording medium P2 to the conveyance route R (S3) after the last recording process for the first recording medium P1 is started (S1). When the motor lock state is detected (S9), the motor lock state process is performed (S10) during the last recording process for the first recording medium P1, and the driving of the motor 102 is stopped (S14) after the last recording process for the first recording medium P1 is completed (S12). Thus, even when the conveyance roller 60 and the discharge roller 62 rotate by stopping the driving of the motor 102 to convey the first recording medium P1 in the conveyance direction, image recording for the first recording medium P1 is performed without any trouble or disturbance, because the image recording for the first recording medium P1 has been already completed then.

Further, the controller 10 starts the feeding of the second recording medium P2 to the conveyance route R (S3) when the registration sensor 120 has detected that the rear end of the first recording medium P1 has passed the registration sensor 120 and the last recording process for the first recording medium P1 is started (51). Thus, the conveyance of the second recording medium P2 can be performed after the registration sensor 120 has detected that the rear end of the first recording medium P1 has passed the registration sensor 120, thus making it possible to inhibit any inconvenience such as a situation in which the first recording medium P1 overlaps with the second recording medium P2.

Second Embodiment

Subsequently, referring to FIG. 7, the image recording apparatus 1 according to the second embodiment of the present disclosure is explained below. For the purpose of convenience, the constitutive parts or components, which have the same functions as those of the first embodiment described above, are designated by the same reference numerals, any explanation therefor is omitted.

The image recording apparatus 1 of the second embodiment is different from the image recording apparatus 1 of the first embodiment in the process flow of the motor lock state process performed by the controller 10. Specifically, although the motor lock state process in which the motor lock state is caused in the last recording process for the first recording medium P1 is explained in the first embodiment, it is assumed in the second embodiment that the motor lock state is caused in any other recording process than the last recording process for the first recording medium P1. FIG. 7 is a flowchart indicating a motor lock state process of the image recording apparatus 1 according the second embodiment. The flowchart in FIG. 7 is an example, and the present disclosure is not limited thereto.

Figure 7:
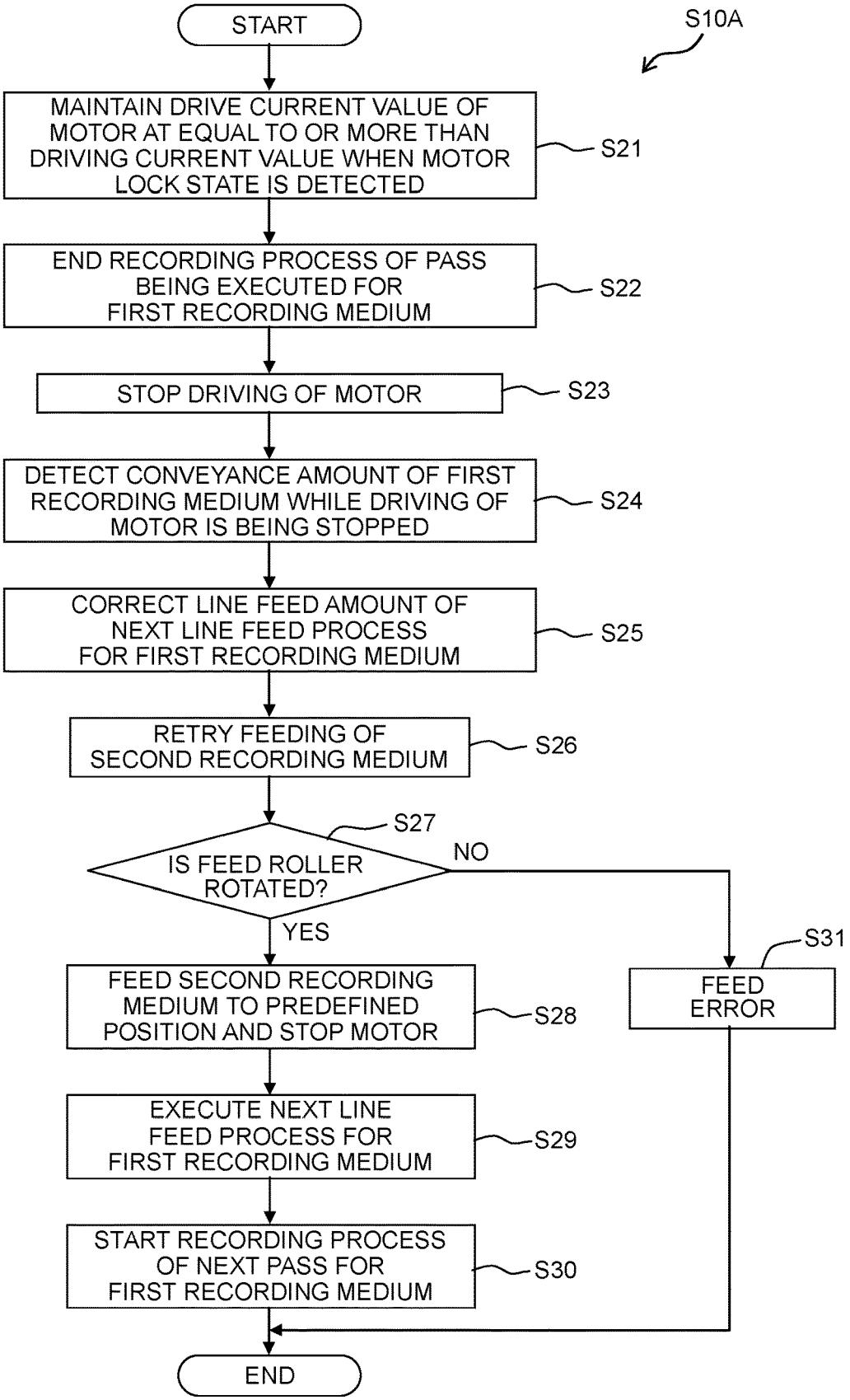
FIG. 7 is a flowchart indicating a process flow of a motor lock state process of an image recording apparatus according to the second embodiment.

As indicated in FIG. 7, in a motor lock state process S10A, the controller 10 performs PWM control to maintain a driving current value of the motor 102 at equal to or more than a driving current value at the timing at which the motor lock state is detected by the encoder 122 (S21). Specifically, the controller 10 controls the driving current value of the motor 102 to be maintained at equal to or more than the driving current value at the timing at which the motor lock state is detected, until ink discharge in a recording process that is being executed when the motor lock state is detected is completed.

This inhibits a state, in which rotation of the feed roller 21 is stopped, from being released immediately which may otherwise be caused by stopping the driving of the motor 102 or lowering the driving current value of the motor 102 immediately after the motor lock state is caused. The controller 10 detects the completion of ink discharge from the recording head 32 in the recording process based on obtained printing data and a position of the carriage 31 detected by the carriage encoder 123.

Subsequently, the controller 10 completes the recording process of a pass that is being executed for the first recording medium P1 (S22). Namely, the controller 10 controls the carriage motor 103 to drive the carriage 31, and controls the recording head 32 to complete the image recording of one pass being executed for the first recording medium P1 at the timing at which the motor lock state is detected.

After S22, the controller 10 stops the driving of the motor 102 (S23). Then, the controller 10 detects a conveyance amount of the first recording medium P1 while (during a time period in which) the driving of the motor 102 is being stopped, namely, a moving amount in the conveyance direction through the conveyance route R (S24). Specifically, the controller 10 detects, based on a pulse signal output from the encoder 121 as a conveyance amount detecting section, a moving amount in which the first recording medium P1 is conveyed through the conveyance route R while the driving of the motor 102 is being stopped. This moving amount is a conveyance amount of the first recording medium P1 in the following situation. Namely, when the driving of the motor 102 is stopped, the motor lock state is released. This rotates the feed roller 21 reversely and instantaneously. The reverse rotation of the feed roller 21 is transmitted to the conveyance roller 60 and the discharge roller 62 via the transmission mechanism 80 to rotate the both rollers 60, 62, which conveys the first recording medium P1 in the conveyance direction unintentionally.

Then, the controller 10 corrects a line feed amount of the next line feed process for the first recording medium P1 by using the conveyance amount detected in S24 (S25). Specifically, the controller 10 corrects the line feed amount of the next line feed process for the first recording medium P1 so that the line feed amount is reduced by an amount corresponding to the conveyance amount of the first recording medium P1 during a time during which the driving of the motor 102 is stopped.

Subsequently, the controller 10 reties the feeding of the second recording medium P2 by again driving and reversely rotating the motor 102 (S26). On this occasion, the controller 10 controls so that a driving current value larger than that for usual feeding flows to the motor 102.

Subsequently, the controller 10 determines whether the feed roller 21 is rotated, based on a pulse signal input from the encoder 122 (S27). When the feed roller 21 is rotated (S27: YES), the controller 10 calculates a feed amount by the feed roller 21 based on the pulse signal input from the encoder 122, feeds the second recording medium P2 to a predefined position in the conveyance route R, and stops the motor 102 (S28). Then, the motor 102 is normally rotated to execute the next line feed process for the first recording medium P1 by the line feed amount corrected in S25 (S29). After the line feed process, the recording process of the next pass for the first recording medium P1 is started (S30). When the feed roller 21 is not rotated (S27: NO), the controller 10 determines that a feed error is caused (S31). Then, the controller 10 ends the motor lock state process S10A of the second embodiment.

The image recording apparatus 1 of the second embodiment as described above can obtain similar effects as the first embodiment. Especially, in the image recording apparatus 1 of the second embodiment, the controller 10 corrects, in the motor lock state process S10A, the line feed amount of the line feed process to be executed after completion of the recording process, depending on the conveyance amount of the first recording medium P1 calculated based on the pulse signal output from the encoder 121 during the time during which the driving of the motor 102 is stopped. This corrects the line feed amount of the line feed process to be executed between the pass that is being executed for the first recording medium P1 at the timing at which the motor lock state is detected and the next pass, and it is possible to inhibit the deviation in image recording at joint or seam portions of the image recorded in continuous passes for the first recording medium P1, as well as a decrease in quality of image recording.

When the motor lock state is detected by the encoder 122, the controller 10 maintains the driving current value of the motor 102 at equal to or more than the driving current value at the timing at which the motor lock state is detected (S21) until the ink discharge in the recording process being executed when the motor lock state is detected is completed. This maintains the driving current of the motor 102 until ink discharge is completed, thus inhibiting a situation in which the first recording medium P1 moves by immediately releasing the state where rotation of the feed roller 21 is stopped. Further, since the motor lock state is not maintained unnecessarily, the load on the motor 102 and the feed roller 21 can be reduced.

Other Embodiments

In the image recording apparatus 1 according to the first embodiment, the conveyer uses the discharge roller 62 that is a roller member and is disposed downstream of the recording section 3 in the conveyance route R. The present disclosure, however, is not limited thereto. The conveyer may be a belt member or a drum member. The conveyer may be disposed upstream of the recording section 3 in the conveyance route R.

In the image recording apparatus 1 of the second embodiment, the controller 10 controls, in S21 of the motor lock state process S10A, the driving current value of the motor 102 at equal to or more than the driving current value at the timing at which the motor lock state is detected, until the ink discharge in the recording process being executed when the motor lock state is detected is completed. The present disclosure, however, is not limited thereto.

For example, when the motor lock state is detected, the controller 10 may maintain the driving current value of the motor 102 at equal to or more than the driving current value at the timing at which the motor lock state is detected until an elapse of a time period required for recording an image of a printing data corresponding to a maximum width of a recordable area on the recording medium P in a moving direction of the carriage 31. In this case, the driving current of the motor can be controlled easily and reliably without detecting an ink discharge state with a sensor or the like, by previously obtaining the time required for the printing of the printing data having the largest width that can be printed on the recording medium P.

The controller 10 may detect the completion of ink discharge from the recording head 32 in the recording process by detecting a control signal sent from the ASIC 15 to the recording head 32. Further, the controller 10 may detect the completion of ink discharge by providing a sensor that detects the ink discharge state in the recording head 32.

In the image recording apparatus 1 of the first embodiment, the registration sensor 120 as the recording medium sensor is disposed between the conveyance roller 60 and the recording section 3 in the conveyance route R. The present disclosure, however, is not limited thereto. The registration sensor 120 may be disposed upstream of the conveyance roller 60 in the conveyance route R. In this configuration, the controller 10 detects a front end position or a rear end position of the recording medium P by use of a signal from the registration sensor 120, and infers a position of the recording medium P in the conveyance route R by calculating a conveyance amount of the recording medium P by use of signals from the encoders 121 and 122.

The present invention is not limited to the embodiments described above, and various changes or modifications may be made without departing from the claims. Embodiments obtained by appropriately combining technical means disclosed in different embodiments are also included in the technical scope of the present invention.

What is claimed is:

1. An image recording apparatus, comprising:

a feed roller configured to feed a recording medium to a conveyance route;

a conveyer configured to convey the recording medium fed to the conveyance route in a conveyance direction;

a recording head disposed downstream of the feed roller in the conveyance direction and configured to record an image by discharging ink onto the recording medium;

a carriage configured to cause the recording head to reciprocate in a direction orthogonal to the conveyance direction;

a motor configured to drive the feed roller and the conveyer;

a transmission mechanism configured to transmit a rotation of the motor in a first direction to the conveyer without transmitting the rotation of the motor in the first direction to the feed roller, and configured to transmit the rotation of the motor in a second direction opposite to the first direction to the feed roller without transmitting the rotation of the motor in the second direction to the conveyer;

a lock detector configured to detect a motor lock state in which the rotation of the motor instructed to drive is being stopped; and a controller, wherein the controller is configured to:

record the image on the recording medium by alternately repeating a line feed process and a recording process, the line feed process being a process in which the conveyer is driven to convey the recording medium in the conveyance direction by a conveyance amount corresponding to a line feed amount determined based on printing data, the recording process being a process in which the carriage is driven in a state where the conveyance of the recording medium is stopped to cause the recording head to record the image;

start feeding of a second recording medium, before the recoding of the image to the first recoding medium is completed, by rotating the motor in the second direction so as to drive the feed roller, the second recording medium being a medium to be conveyed next to the first recording medium;

continue, in a case that the motor lock state is detected by the lock detector before the recording of the image to the first recording medium is completed, a control for rotating the motor in the second direction, until a process for recoding the image to the first recording medium being executed at a timing when the motor lock state is detected, is completed; and stop a driving of the motor after the process for recoding the image to the first recording medium is completed.

2. The image recording apparatus according to claim 1, wherein the conveyer includes a discharge roller configured to discharge the recording medium after the recording of the image to the recording medium is completed, and the controller is configured to start feeding of the second recording medium, before the recoding of the image to the first recoding medium is completed, by rotating the motor in the second direction so as to drive the feed roller in a state that the first recording medium is brought into contact with the discharge roller.

3. The image recording apparatus according to claim 1, wherein the controller is configured to maintain, in a case that the motor lock state is detected by the motor lock detector, a driving current value of the motor at equal to or more than a driving current value at a timing when the motor lock state is detected, until the driving of the motor is stopped.

4. The image recording apparatus according to claim 1, further comprising a discharge detector configured to detect completion of discharge of the ink from the recording head in the process for recording the image, and the controller is configured to maintain, in a case that the motor lock state is detected by the motor lock detector, a driving current value of the motor at equal to or more than a driving current value at a timing when the motor lock state is detected, until the discharge of the ink in the process for recording the image being executed at a timing when the motor lock state is detected, is completed.

5. The image recording apparatus according to claim 1, wherein the controller is configured to maintain, in a case that the motor lock state is detected by the motor lock detector, a driving current value of the motor at equal to or more than a driving current value at a timing when the motor lock state is detected, until an elapse of a time period required for recording an image of a printing data corresponding to a maximum width of a recordable area on the recording medium in a moving direction of the carriage.

6. The image recording apparatus according to claim 1, wherein the controller is configured to feed the second recording medium, after the driving of the motor is stopped, by again rotating the motor in the second direction to drive the feed roller, in a state where the carriage is stopped.

7. The image recording apparatus according to claim 6, wherein the controller is configured to make a driving current value of the motor in the case that the second recording medium is again fed, larger than a driving current value of the motor in a case that the second recording medium is normally fed.

8. The image recording apparatus according to claim 1, wherein the lock detector includes at least one of an encoder configured to detect rotation of the feed roller and a current sensor configured to detect a driving current value of the motor.

9. The image recording apparatus according to claim 1, wherein the controller is configured to start the feeding of the second recording medium to the conveyance route after a last process for recording the image, among the plurality of processes for recording the image to the first recording medium, is started.

10. The image recording apparatus according to claim 9, further comprising:

a conveyance roller configured to convey the recording medium fed to the conveyance route to an image recording position; and a recording medium sensor configured to detect that the recording medium has passed the conveyance roller, wherein the controller is configured to start the feeding of the second recording medium in a case that the recording medium sensor has detected that the first recording medium has passed the recording medium sensor and the last process for recording the image to the first recording medium is started.

11. The image recording apparatus according to claim 1, comprising a conveyance amount detector configured to detect the conveyance amount of the recording medium, wherein the controller is configured to correct a line feed amount in the line feed process executed after completion of the recording process depending on the conveyance amount of the recording medium that is detected by the conveyance amount detecting section during a period in which the driving of the motor is being stopped.

* * * * *